US006474566B1

(12) United States Patent
Hirota et al.

(10) Patent No.: US 6,474,566 B1
(45) Date of Patent: Nov. 5, 2002

(54) DROP DISCHARGE DEVICE

(75) Inventors: Toshikazu Hirota, Kuwana; Takao Ohnishi, Aichi-ken, both of (JP)

(73) Assignee: NGK Insulators, Ltd., Nagoya (JP)

( * ) Notice: Subject to any disclaimer, the term of this patent is extended or adjusted under 35 U.S.C. 154(b) by 36 days.

(21) Appl. No.: 09/606,380

(22) Filed: Jun. 28, 2000

(30) Foreign Application Priority Data

Jun. 20, 2000 (JP) ..... 2000-185494

(51) Int. Cl.[7] ..... B05B 1/08
(52) U.S. Cl. ..... 239/102.2; 347/45
(58) Field of Search ..... 239/102.1, 102.2; 347/45

(56) References Cited

U.S. PATENT DOCUMENTS 5,152,456 A * 10/1992 Ross et al. ..... 239/102.2
5,437,255 A 8/1995 Sadley et al.
5,489,928 A * 2/1996 Takahashi et al. ..... 347/45
5,563,640 A * 10/1996 Suzuki ..... 347/45
5,786,832 A * 7/1998 Yamanaka et al. ..... 347/45
5,798,775 A * 8/1998 Takahashi et al. ..... 347/33
5,829,411 A * 11/1998 Cooper et al. ..... 123/450
5,840,062 A 11/1998 Gumaste et al.

FOREIGN PATENT DOCUMENTS

JP 54-090416 A 7/1979
JP 60-022065 A 2/1985
JP 61-011451 A 1/1986
JP 4-134176 A 5/1992

* cited by examiner

*Primary Examiner*—Lesley D. Morris
*Assistant Examiner*—Dinh Q Nguyen
(74) *Attorney, Agent, or Firm*—Burr & Brown

(57) ABSTRACT

A drop discharge device is provided, including a pressurizing means for achieving discharge of liquid such as raw material or fuel, a pressurizing chamber for pressurizing liquid to be discharged, a nozzle connected to a lower portion of the pressurizing chamber for discharging liquid to a processing unit of the raw material/fuel discharge device, a layer for repelling liquid disposed in a periphery of a discharge hole of the nozzle, and an introducing hole for supplying liquid to the pressurizing chamber. The layer for repelling liquid includes a layer formed to extend over the entire bottom surface of the pressurizing chamber made of fluorocarbon polymers, and grooves for repelling liquid around the discharge hole of the nozzle.

18 Claims, 5 Drawing Sheets

DROP DISCHARGE DEVICE

FIELD OF THE INVENTION

The present invention relates to a drop discharge device for discharging liquid raw material or fuel for processing or actuating the fluid thereby, the device being assembled to a raw material/fuel discharge device of various apparatuses.

BACKGROUND OF THE INVENTION

A conventional drop discharge device typically includes a pressurizing means for achieving discharge of liquid, a pressurizing chamber for achieving discharge of liquid to be discharged, a liquid discharge nozzle connected to the pressurizing chamber, and an introducing hole for supplying liquid to the pressurizing chamber. Usually, a plurality of such devices are assembled to a driving means for a raw material/fuel discharge device as units for discharging minute liquid-drops. The liquid introducing holes of the plurality of adjoining drop discharge devices are connected to a common liquid supply path, and piezoelectric/electrostrictive elements are provided on a part of wall portions of the liquid pressuring chambers. To actuate the driving means for the raw material fuel discharge device, wall portions of the liquid pressurizing chambers are deformed by applying specified voltage signals to the piezoelectric/electrostrictive elements, and through pressure generated in the liquid pressurizing chambers, liquid supplied to the liquid pressuring chambers are sprayed out from the nozzles.

When liquid was to be discharged in large amounts for some applications of a raw material/fuel discharge device, the number of nozzles of the plurality of drop discharge devices to be mounted was increased, and time intervals for applying the specified voltage signals to the piezoelectric/electrostrictive elements were decreased to thereby improve voltage application per unit time to decrease discharge cycles, or the voltage was increased.

However, when liquid is to be discharged in large amounts and further in a successive manner as in the above-described case, that is, when a plurality of nozzles which perform discharge at a flow rate of not less than several tens of pL per one discharge of a single nozzle, at a discharge cycle of not less than several kHz, and for not less than several tens of ms, are provided at distances of several hundreds of $\mu$m, liquid-drops will remain in the nozzles or on the peripheries thereof and result in unstable discharge or a phenomena in which discharged drops are absorbed by liquid-drops on the nozzle peripheries to make spraying impossible.

SUMMARY OF THE INVENTION

Thus, the inventors of the present invention have devised a drop discharge device comprising a pressurizing means for achieving discharge of liquid, a pressurizing chamber for pressurizing the liquid to be discharged, a liquid discharge nozzle connected to the liquid pressurizing chamber, and a layer treated for repelling the liquid disposed around the discharge hole of the nozzle, wherein the layer for repelling liquid includes portions of different liquid-repelling properties spaced from each other. With this arrangement, liquid-drops that have been discharged from the nozzle, but remain as large liquid-drops on the layer treated for repelling liquid without being scattered, will be eliminated at portions of different liquid-repelling properties, and discharge deficiencies caused through liquid-drop residues at the nozzle discharge outlet will be prevented.

The layer treated for repelling liquid comprised by arranging portions of different liquid-repelling properties spaced from each other includes, in addition to a first liquid-repelling layer disposed in a periphery of the discharge hole of the nozzle, at least a second liquid-repelling layer connected to an outer edge of the first liquid-repelling layer, wherein liquid-repelling properties of the second liquid-repelling layer of different liquid-repelling properties may be either superior or inferior than those of the first liquid-repelling layer.

According to another embodiment of the present invention, portions with inferior liquid-repelling properties from among the portions of different liquid-repelling properties of the layer for repelling liquid may be formed by gaps in the layer for repelling liquid at the stage of designing or by thinning the layer thickness or partially omitting the layer for repelling liquid by performing cutting, dissolving or decomposing after forming.

An invention according to another embodiment relates to a drop discharge device with portions with inferior liquid-repelling properties from among the portions of different liquid-repelling properties of the layer are formed by cutting, dissolving or decomposing the layer for repelling liquid to assume concave sections. An invention according to another embodiment relates to a drop discharge device with portions of different liquid- repelling properties of the layer are formed of a layer treated for repelling liquid made of a material with different liquid-repelling properties.

An invention according to another embodiment relates to a drop discharge device wherein distances L from boundaries of portions of different liquid-repelling properties of the layer treated for repelling liquid to an outer periphery of the discharge hole of the nozzle are identical to each other. With this arrangement, liquid-drops will contact boundaries of portions of different liquid-repelling properties regardless of an expanding direction of the liquid-drops so that liquid may be reliably omitted.

The distance L from boundaries of portions of different liquid-repelling properties of the layer treated for repelling liquid to the outer periphery of the discharge hole of the nozzle is preferably in a range of 200 to 500 $\mu$m. In case the distance L is not less than 200 $\mu$m, exact positioning to the outer edge of the discharge hole of the nozzle is enabled, a layer thickness thereof made large to be hard to peel off, and a liquid-repelling layer of high durability can be obtained. Since the distance L is not more than 500 $\mu$m, which is a maximum diameter of a general liquid-drop causing unstable discharge of the nozzle, liquid-drops in larger conditions will contact portions of different liquid-repelling properties to be eliminated, and it is accordingly possible to prevent discharge deficiencies owing to liquid-drops remaining in the nozzle discharge outlet.

Another embodiment of the present invention relates to a drop discharge device wherein distances L from boundaries of portions of different liquid-repelling properties of the layer treated for repelling liquid to an outer periphery of the discharge hole of the nozzle satisfy $d>L>0.1\ d$ with respect to a maximum liquid-drop diameter d of a discharged liquid-drop formed on the layer treated for repelling liquid.

Here, the maximum liquid-drop diameter d of discharged liquid formed on the layer treated for repelling liquid is a liquid-drop diameter obtained in a measuring device with a surface on which the nozzle is formed being provided in a vertical manner and a discharge direction of liquid-drops set in a horizontal manner, when a liquid-drop formed on the liquid-repelling surface is deformed from its drop-like shape or is dropped downward.

Another embodiment of the present invention relates to a drop discharge device wherein a plurality of nozzles are provided with a pressurizing chamber with distances M between outer peripheries of discharge holes of adjoining nozzles which satisfy d<M with respect to a maximum liquid-drop diameter d of a discharged liquid-drop formed on the layer treated for repelling liquid.

According to another embodiment of the present invention wherein liquid- repelling properties of a second liquid-repelling layer of different liquid-repelling properties are inferior than those of the first liquid-repelling layer, the drop discharge device in any one of the above embodiments is arranged in that a porous liquid absorbing layer is disposed on a periphery of the layer treated for repelling liquid. With this arrangement, even if liquid-drop remaining in the nozzle discharge outlet to cause discharge deficiencies shall become large, this liquid-drop will be penetrated upon contacting the liquid absorbing layer so that the liquid-drop that has become larger will be reduced to a size similar to those at peripheries of the discharge hole of the nozzle.

An invention according to another embodiment of the present invention provides a drop discharge device according to any one of the above embodiments, wherein the nozzle(s) and pressurizing chamber are made of zirconia ceramics. With this arrangement, wettability of flow paths within the nozzle and the pressuring chamber with fluid will be improved such that air bubbles hardly remain or intermingle, and discharge may be stabilized.

DETAILED DESCRIPTION OF THE INVENTION

Forms for embodying the drop discharge device according to the present invention will now be explained in detail.

Figure 1:
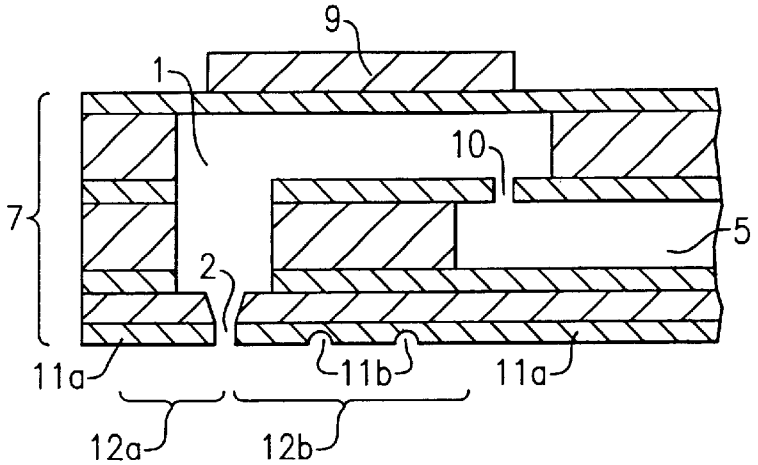
FIG. 1 is an explanatory view showing a central longitudinal sectional view of the drop discharge device.

FIG. 1 is a central longitudinal sectional view of the drop discharge device. The drop discharge device comprises a pressurizing means for achieving discharge of liquid such as raw material or fuel, a pressurizing chamber 1 for pressurizing liquid to be discharged, a nozzle 2 connected to a lower portion of the pressurizing chamber 1 for discharging liquid to a processing unit of the raw material fuel discharge device, a layer treated for repelling liquid 11 disposed in a periphery of a discharge hole 2*a* of the nozzle 2, and an introducing hole 10 for supplying liquid to the pressurizing chamber 1. The layer treated for repelling liquid 11 is composed of a layer treated for repelling liquid 11*a* formed to extend over the entire bottom surface of the pressurizing chamber 1 and made of fluorocarbon polymers, and grooves for repelling liquid 11*b* engraved in peripheries of the discharge hole 2*a*.

Such a drop discharge device 7 comprises a single unit, and a plurality of such devices are mounted to a raw material/fuel discharge device by units of several to several hundreds, depending on the form of application of the raw material fuel discharge device. A plurality of adjoining pressurizing chambers 1 are connected to a common liquid supply path 5 through respective liquid introducing holes 10, and a piezoelectric/electrostrictive element 9 is provided on a part of an upper wall portion of each liquid pressurizing chamber 1. The piezoelectric/electrostrictive element 9 is formed by laminating an upper electrode, a piezoelectric/electrostrictive layer and a lower electrode, and by applying a specified voltage signal, the piezoelectric/electrostrictive layer is deformed through an electric field generated between the upper electrode and the lower electrode, and through pressurizing force generated in the liquid pressurizing chamber 1 for deforming the fixedly attached wall portion of the liquid pressurizing chamber 1, liquid supplied to the liquid pressurizing chamber 1 is accordingly sprayed from the nozzle 2.

At this time, should liquid-drop 12*a* be held on the layer treated for repelling liquid 11*a* without being scattered, contact of an end portion of the liquid-drop with the grooves for repelling liquid 11*b* as illustrated by liquid-drop 12*b*, this liquid-drop will flow along the grooves for repelling liquid 11*b* owing to the degraded liquid-repelling properties of the grooves treated for repelling liquid to reduce the size of the liquid-drop to be finally scattered.

By arranging the nozzle 2 and the pressurizing chamber 1 of zirconia ceramics, wettability within the flow paths of the nozzle 2 and the pressurizing chamber 1 with liquid is improved such that air bubbles hardly remain or intermingle, and discharge may be stabilized. This can be achieved by forming structural walls of the pressurizing chamber 1 of zirconia ceramics and by forming the nozzle in a piercing manner, while it is necessary to coat at least inner walls of the nozzle 2 and the pressurizing chamber 1 with zirconia ceramics.

Figure 2A:
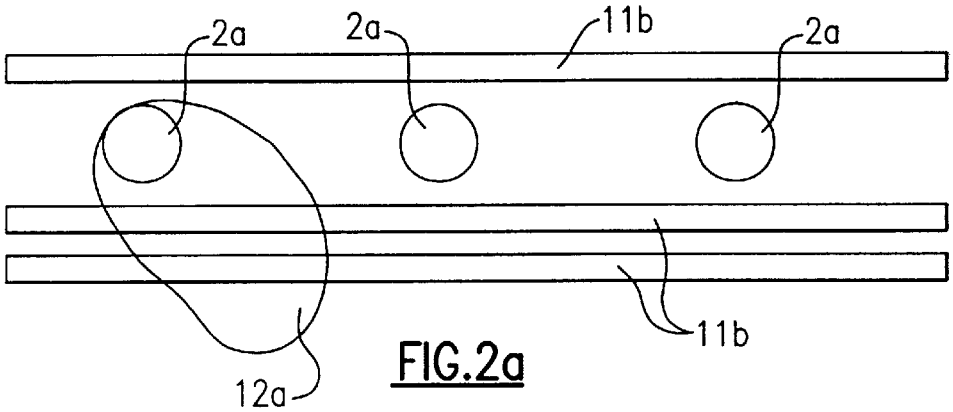
FIG. 2 is an explanatory view showing a bottom surface of a pressurizing chamber of the drop discharge device.
Figure 2B:
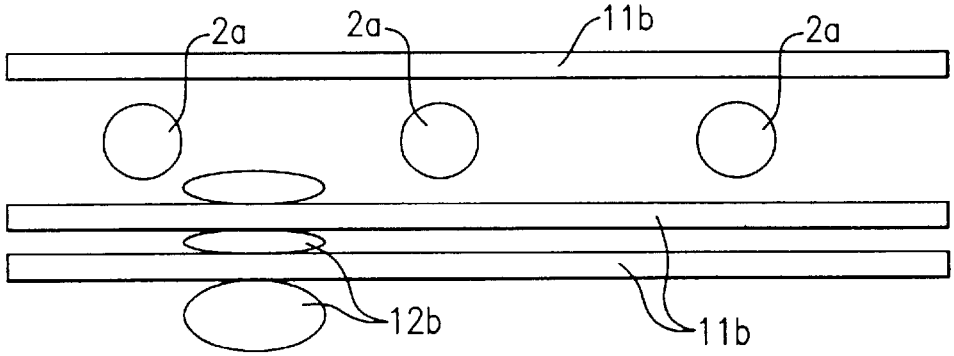

FIG. 2 illustrates a bottom surface of the liquid pressurizing chamber 1, wherein grooves for repelling liquid 11*b* are engraved along aligning directions of the discharge holes 2*a* of the nozzles 2. FIG. 2(*a*) illustrates a condition in which a liquid-drop 12*a* is adhering without being scattered, and 2(*b*) illustrates liquid-drops 12*b* that have become smaller along the grooves for repelling liquid 11*b*.

Figure 3:
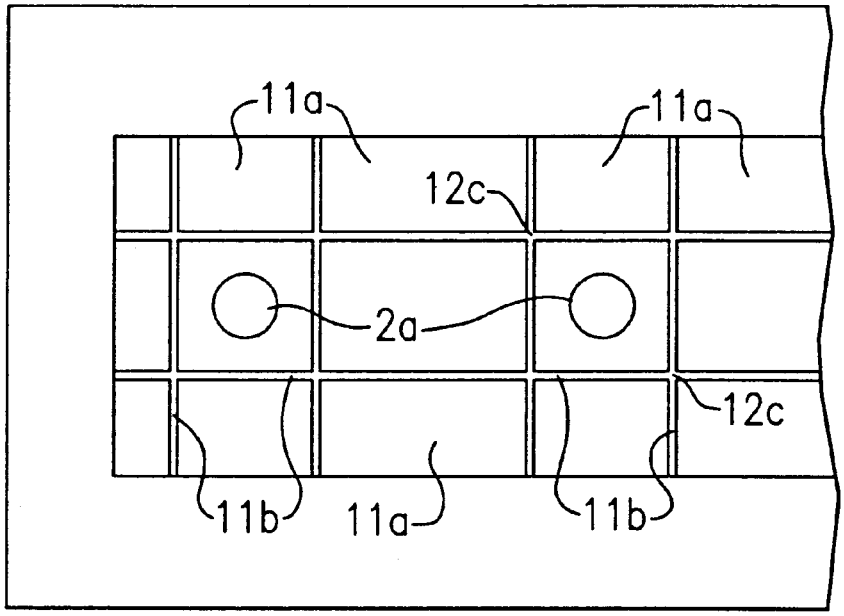
FIG. 3 is an explanatory view for explaining conditions for arranging different grooves treated for repelling liquid.
Figure 4:
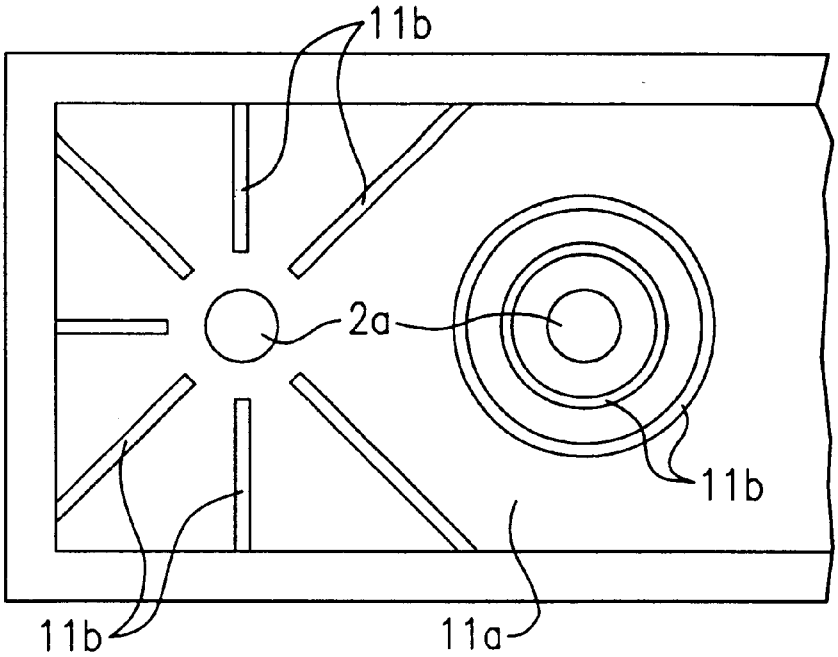
FIG. 4 is an explanatory view for explaining conditions for arranging different grooves for repelling liquid.

FIGS. 3 and 4 illustrate embodiments of the grooves for repelling liquid 11*b* of different arrangements. While the grooves for repelling liquid 11*b* are disposed along an aligning direction of the discharge holes 2*a* of the nozzles 2 in FIG. 2, FIG. 3 includes grooves treated for repelling liquid 11*b* disposed to be orthogonal to the aligning direction of the discharge holes 2*a* in addition to the grooves treated for repelling liquid 11*b* disposed along the aligning direction of the discharge holes 2*a*, wherein overlapping portions 12*c* duplicated for securing spaces for liquid-drops to flow.

The grooves for repelling liquid 11*b* of FIG. 4 are disposed to be geometrically symmetric with the discharge holes 2*a* forming the center, that is, grooves are disposed at equal intervals in scattering directions of liquid-drops. More particularly, 2(*a*) is arranged in a radial manner while 2(*b*) is arranged in a concentric manner such that distances for making liquid-drops flow may be set longer.

Further, as illustrated in FIGS. 3 and 4, the layer for repelling liquid formed in a periphery of the discharge holes 2*a* of the nozzles 2 need to be formed only in proximate portions of the nozzles, and portions of different liquid-repelling properties that are formed on these portions may be arranged in that their ends are connected to portions that are not formed with a layer for repelling liquids as illustrated in FIG. 3 or in the radial arrangement on the left-hand side of FIG. 4. In this case, it is possible to exhibit an advantage that liquid-drops that have flown out along portions of different liquid-repelling properties can be effectively eliminated from peripheries of the nozzles.

The term "layer for repelling liquid" is defined to be a location of inferior properties of wettability with respect to liquid to be discharged than those of materials used for forming the nozzles, and includes fluorocarbon polymers layers, plated layers including fluorine, resin layers including fluorine, silicone resin layer, or a portion made of a same material as that used for forming the nozzles while its surface roughness is arranged to be smooth.

The "portions of different liquid-repelling properties" that are formed thereat may be formed by first forming a layer treated for repelling liquid and thereafter thinning the thickness thereof or omitting it through machine processing or laser processing, by designing the corresponding portions to be thin in thickness or to be omitted simultaneously with forming the first layer, by further overlapping a layer of different liquid-repelling properties onto a readily provided layer, or by stacking the same layer of identical properties for varying the liquid-repelling properties.

Figure 5:
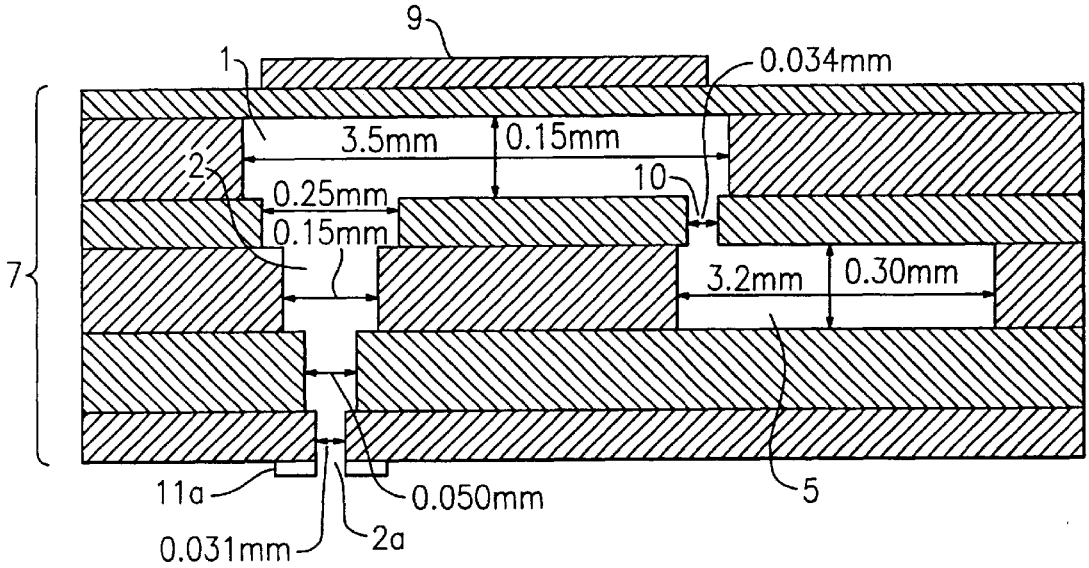
FIG. 5 is an explanatory view for particularly defining respective width of drop discharge devices formed by using green sheets.

FIG. 5 is an explanatory view for particularly defining respective width of drop discharge devices formed by using green sheets. A width of the path of the liquid supply path 5 is defined to be 3.2 mm, a layer thickness thereof to 0.30 mm, a diameter of the introducing hole 10 to 0.034 mm. The pressurizing chamber 1 has a chamber length of 3.5 mm and a layer thickness of 0.15 mm. The discharge nozzle 2 is formed in a staged manner of different diameters that are defined to be 0.25 mm, 0.15 mm, 0.050 mm, and 0.031 mm, respectively, in this order in approaching the discharge direction.

Values of maximum liquid-drop diameters d of formed liquid-drops with respect to the above-described layer treated for repelling liquid 11*a* will be as follows, depending on the various materials. It should be noted that a maximum liquid-drop diameter d of a discharged liquid-drop that is formed on the layer treated for repelling liquid is defined to be a liquid-drop diameter obtained in a measuring device with a surface on which the nozzle is formed being provided in a vertical manner and a discharge direction of liquid set in a horizontal manner, wherein a liquid-drop formed on the liquid-repelling surface is deformed from its drop-like shape or is dropped downward.

TABLE 1

| Type of liquid/Type of liquid-repelling layer | Fluorocarbon polymers | Silicone resin | |
|---|---|---|---|
| Gasoline | 1.5 | 2 | |
| Light oil | 3 | 4 | |
| Secondary petroleum group solvent | 2 | 3 | |
| Water | 5 | 7 | (units in mm) |

It is evident from these measured values that distances L from boundaries of portions of different liquid-repelling properties of the layer for repelling liquid to an outer periphery of the discharge hole 2*a* of the nozzle 2 satisfy $d>L>0.1\,d$ with respect to a maximum liquid-drop diameter d of discharged liquid-drop formed on the layer for repelling liquid. For instance, in case the type of liquid is gasoline and the layer for repelling liquid is formed of fluorocarbon polymers, it is preferable to satisfy $1.5>L>1.5\times0.1$. In case L is smaller than 0.1 d, forming of the layer for repelling liquid may be difficult and liquid-repelling properties may be degraded owing to a shift in position with respect to the nozzle, while in case L is larger than d, liquid-drops will continuously reside in proximities of the nozzle to be a hindrance for the following discharge of liquid-drops and thus to cause deficiencies in spraying.

Figure 6:
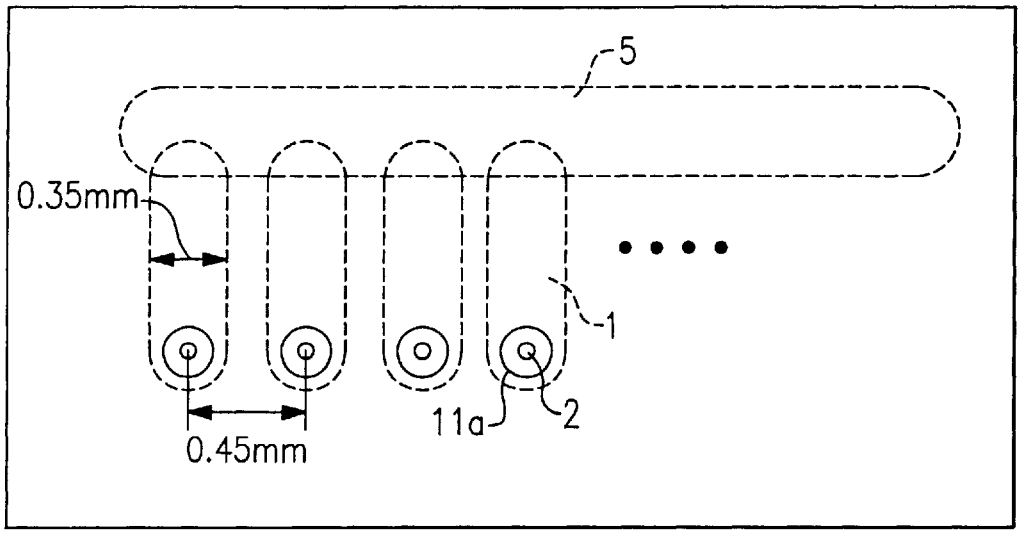
FIG. 6 is an explanatory view of a nozzle surface wherein a single nozzle is provided for a liquid pressurizing chamber 1.
Figure 7:
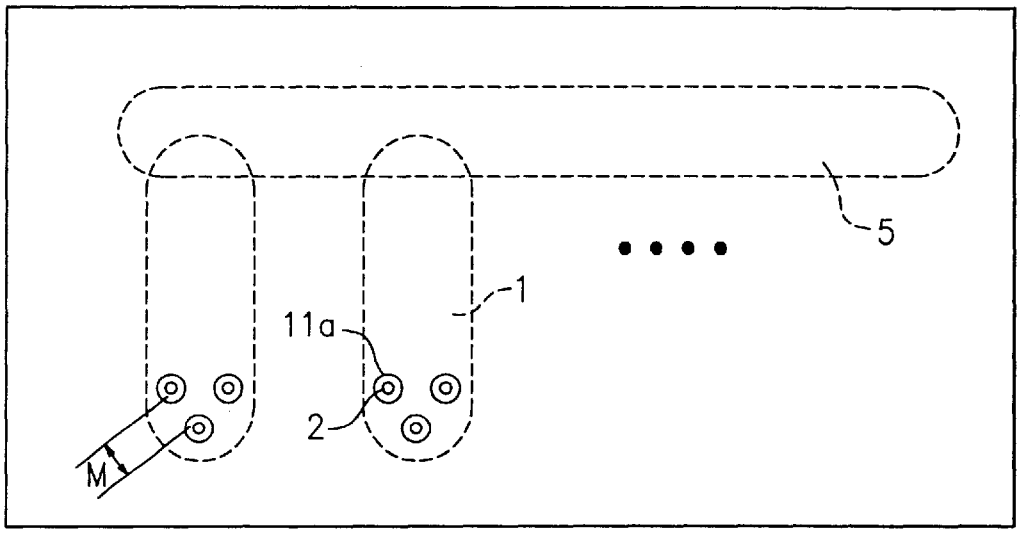
FIG. 7 is an explanatory view of a nozzle surface wherein a plurality of nozzles is provided for the liquid pressurizing chamber 1.

FIGS. 6 and 7 illustrate nozzle surfaces with a plurality of liquid pressurizing chambers 1 of chamber widths of 0.35 mm provided for a single liquid supply path 5.

In FIG. 6, the plurality of liquid pressurizing chambers 1 are connected to the liquid supply path 5 at one end thereof while a single nozzle 2 is formed on each of the other ends, and a layer for repelling liquid 11*a* is disposed to surround the nozzle 2 in a disk-like manner. Each disk-like disposed layer for repelling liquid 11*a* is arranged in that their distances L from the boundaries of portions of different liquid-repelling properties to the outer edges of the discharge holes of the nozzles are identical. Intervals between adjoining nozzles 2 are set to be 0.45 mm.

On the other hand, in FIG. 7, the plurality of liquid pressurizing chambers 1 are connected to the liquid supply path 5 at one end thereof while a plurality of three nozzles 2 are provided at each of the other ends, and layers for repelling liquid 11*a* are disposed to surround each of the nozzles 2 in a disk-like manner. Distances M between outer edges of discharge holes of adjoining nozzles 2 will satisfy $d<M$ with respect to a maximum liquid-drop diameter d of discharged liquid-drops formed on the layers for repelling liquid 11*a*. In this manner, when the liquid-drop reaches the maximum diameter d, the liquid-drop will vanish through the layer for repelling liquid 11*a* so as to prevent deficiencies in discharge of more than two nozzles caused by a liquid-drop formed by adhering to a single nozzle to further affect the adjoining nozzle.

Figure 8A:
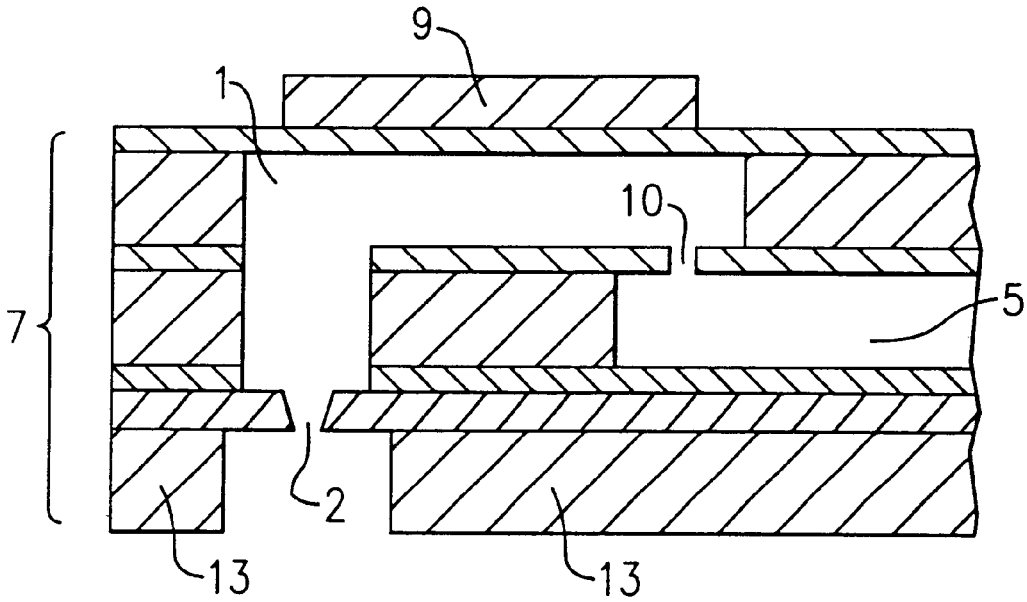
FIG. 8 is an explanatory view of a drop discharge device including a liquid-absorbing layer.
Figure 8B:
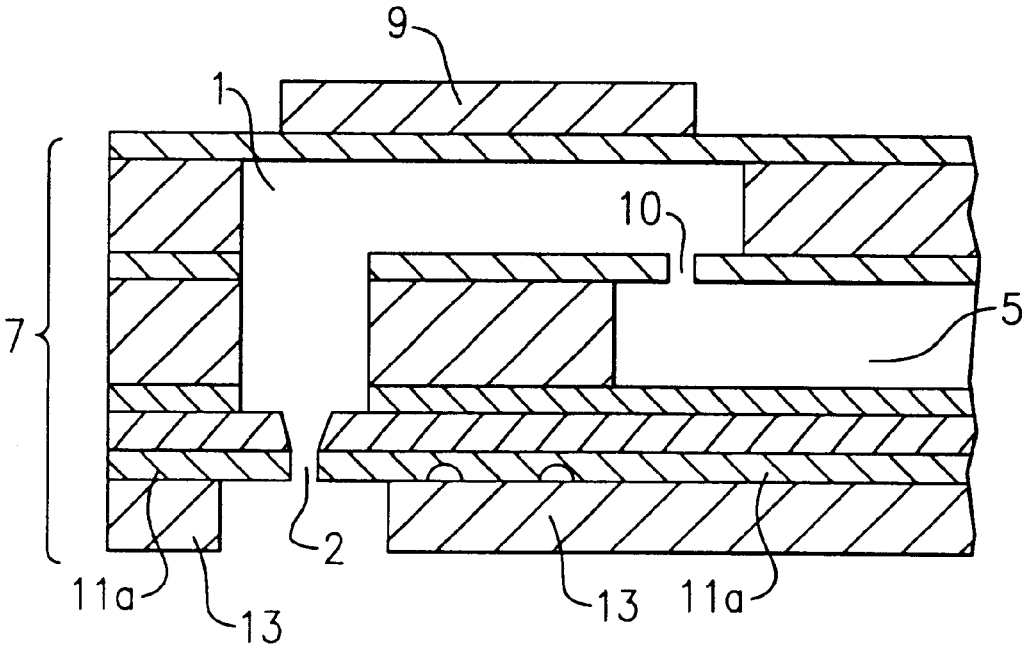

In FIG. 8, a porous liquid-adsorbing layer 13 for absorbing liquid is laminated onto the layer for repelling liquid 11 as illustrated in FIG. 1 in a periphery of the discharge hole 2*a* of the nozzle 2. With this arrangement, liquid-drops once remaining in the periphery of the nozzle 2 are absorbed by the liquid-absorbing layer 13 so that no liquid-drops will remain in the periphery of the nozzle 2 any more, while the absorbed liquid will be gradually evaporated from its surface owing to the porous properties of the liquid-absorbing layer 13 so that remaining liquid-drops will be continuously absorbed. It should be noted that in FIG. 8(*a*), the liquid-absorbing layer 13 is laminated in a periphery of the nozzle 2 such that the liquid-absorbing layer 13 comes into contact with air, while it is alternatively possible to employ the arrangement of FIG. 8(*b*) wherein the layer for repelling liquid 11 is formed in the periphery of the nozzle 2 and the liquid-absorbing layer 13 is fixedly attached onto the bottom surface of the pressurizing chamber 1 as to be outwardly aligned to the layer 11.

As it has been explained so far, according to one embodiment of the present invention, the layer for repelling liquid is comprised by arranging portions of different liquid-repelling properties parallel to (i.e., spaced from) each other. With this arrangement, liquid-drops that have been discharged from the nozzle, and are held on the layer for repelling liquid as a large drop without being scattered, can be eliminated through portions of different liquid-repelling properties, and it is accordingly possible to prevent deficiencies in discharge owing to liquid-drop residues formed on nozzle discharge outlets. It is further possible to prevent the occurrence of discharge deficiencies due to changes in the volume of air-bubble portions through pressurizing at the time of filling liquid into the entire flow path, including the pressurizing chamber, caused by air-bubble residues being pinched between liquid remaining in the nozzle discharge outlet and liquid supplied by starting discharge.

What is claimed is:

1. A drop discharge device for discharging a liquid comprising:

pressurizing means for discharging the liquid;

a pressurizing chamber for pressurizing the liquid to be discharged;

a liquid discharge nozzle connected to said liquid pressurizing chamber; and a layer for repelling the liquid, said layer being disposed around a discharge hole of said nozzle, wherein said layer for repelling liquid comprises portions of different liquid-repelling properties spaced from each other.

2. The drop discharge device of claim 1, wherein portions having inferior liquid-repelling properties are formed from among said portions of different liquid-repelling properties of said layer for repelling liquid by gaps in said layer.

3. The drop discharge device of claim 1, wherein portions having inferior liquid-repelling properties are formed from among said portions of different liquid-repelling properties of said layer for repelling liquid by concave regions of said layer.

4. The drop discharge device of claim 1, wherein said portions of different liquid-repelling properties of said layer for repelling liquid are formed of a layer for liquid made of a material having different liquid-repelling properties.

5. The drop discharge device of claim 1, wherein distances, L, from the boundaries of said portions of different liquid-repelling properties of said layer for repelling liquid to an outer periphery of said discharge hole of said nozzle are identical to each other.

6. The drop discharge device of claim 5, wherein distances L from the boundaries of said portions of different liquid-repelling properties of said layer for repelling liquid to an outer periphery of said discharge hole of said nozzle satisfy $d>L>0.1\ d$ with respect to a maximum liquid-drop diameter, d, of a discharged liquid-drop formed on said layer for repelling liquid.

7. The drop discharge device of claim 5, wherein a plurality of nozzles are provided with distances M between outer peripheries of discharge holes of adjoining nozzles which satisfy $d<M$ with respect to a maximum liquid-drop diameter, d, of a discharged liquid-drop formed on the layer treated for repelling liquid.

8. The drop discharge device of claim 7, wherein said nozzles and pressurizing chamber comprise zirconia ceramics.

9. The drop discharge device of claim 5, wherein a porous liquid absorbing layer is disposed on said layer for repelling liquid.

10. The drop discharge device of claim 9, wherein said absorbing layer extends around said nozzle discharge opening and is spaced thereon.

11. The drop discharge device of claim 5, wherein said nozzle and said pressurizing chamber comprise zirconia ceramics.

12. The drop discharge device of claim 1, wherein distances L from the boundaries of said portions of different liquid-repelling properties of said layer for repelling liquid to an outer periphery of said discharge hole of said nozzle satisfy $d>L>0.1\ d$ with respect to a maximum liquid-drop diameter, d, of a discharged liquid-drop formed on said layer for repelling liquid.

13. The drop discharge device of claim 1, wherein a plurality of nozzles are provided at distances M between an outer periphery of said discharge holes of adjoining nozzles, such that $d<M$ with respect to a maximum liquid drop diameter, d, of a discharged liquid drop formed on said layer for repelling liquid.

14. The drop discharge device of claim 13, wherein said nozzles and said pressurizing chamber comprise zirconia ceramics.

15. The drop discharge device of claim 1, wherein a porous liquid absorbing layer is disposed on said layer treated for repelling liquid.

16. The drop discharge device of claim 15, wherein said absorbing layer extends around said nozzle discharge opening and is spaced thereon.

17. The drop discharge device of claim 1, wherein said nozzle and said pressurizing chamber comprise zirconia ceramics.

18. A liquid dispensing apparatus having one or more drop discharge devices according to claim 1.

* * * * *